US007432646B2

(12) United States Patent
Choi et al.

(10) Patent No.: US 7,432,646 B2
(45) Date of Patent: Oct. 7, 2008

(54) THERMAL ELECTRON EMISSION BACKLIGHT DEVICE

(75) Inventors: Jun-Hee Choi, Seongnam-si (KR); Deuk-Seok Chung, Seongnam-si (KR); Byong-Gwon Song, Seoul (KR); Andrei Zoulkarneev, Suwon-si (KR); Chan-Wook Baik, Seongnam-si (KR); Ha-Jong Kim, Seongnam-si (KR); Moon-Jin Shin, Yongin-si (KR); Ho-Suk Kang, Seoul (KR)

(73) Assignee: Samsung SDI Co., Ltd., Suwon-si, Gyeonggi-do (KR)

( * ) Notice: Subject to any disclaimer, the term of this patent is extended or adjusted under 35 U.S.C. 154(b) by 111 days.

(21) Appl. No.: 11/432,533

(22) Filed: May 12, 2006

(65) Prior Publication Data

US 2006/0261726 A1 Nov. 23, 2006

(30) Foreign Application Priority Data

May 23, 2005 (KR) ..... 10-2005-0043158

(51) Int. Cl.
*H01J 1/62* (2006.01)
*H01J 63/04* (2006.01)

(52) U.S. Cl. ..... 313/497; 313/309; 313/292

(58) Field of Classification Search ..... 313/496
See application file for complete search history.

(56) References Cited

U.S. PATENT DOCUMENTS 5,760,858 A 6/1998 Hodson et al.
6,717,350 B2 * 4/2004 Yonezawa et al. ..... 313/495
6,777,869 B2 * 8/2004 Pavlovsky ..... 313/496
6,949,877 B2 * 9/2005 Sun et al. ..... 313/491
7,193,357 B2 * 3/2007 Choi et al. ..... 313/495
2004/0061136 A1 * 4/2004 Tyan et al. ..... 257/200
2005/0179363 A1 * 8/2005 Choi et al. ..... 313/497
2006/0091782 A1 * 5/2006 Liu et al. ..... 313/496
2006/0232207 A1 * 10/2006 Sugimoto et al. ..... 313/582
2006/0250066 A1 * 11/2006 Liu et al. ..... 313/310

* cited by examiner

*Primary Examiner*—Karabi Guharay
*Assistant Examiner*—Britt Hanley
(74) *Attorney, Agent, or Firm*—Robert E. Bushnell, Esq.

(57) ABSTRACT

A thermal electron emission backlight device comprises: a first substrate and a second substrate disposed in parallel and separated by a predetermined distance from each other; a first anode electrode and a second anode electrode facing the first anode electrode, the first and second anode electrodes being formed on inner surfaces of the first substrate and the second substrate, respectively; cathode electrodes disposed at predetermined intervals and in parallel with each other between the first substrate and the second substrate; a phosphor layer formed on the second anode electrode; and a plurality of spacers disposed between the first substrate and the second substrate so as to maintain the predetermined distance therebetween. When a predetermined voltage is applied to the cathode electrodes, thermal electrons are emitted from the cathode electrodes.

16 Claims, 4 Drawing Sheets

THERMAL ELECTRON EMISSION BACKLIGHT DEVICE

CLAIM OF PRIORITY

This application makes reference to, incorporates the same herein, and claims all benefits accruing under 35 U.S.C.§ 119 from an application for FIELD EMISSION BACKLIGHT DEVICE EMITTING THERMAL ELECTRON earlier filed in the Korean Intellectual Property Office on the 23$^{rd}$ of May 2005 and there duly assigned Ser. No. 10-2005-0043158.

BACKGROUND OF THE INVENTION

1. Technical Field

The present invention relates to a thermal electron emission backlight device and, more particularly, to a back light device that emits white light by exciting a phosphor layer using thermal electrons.

2. Related Art

A backlight device which emits white light is installed on a rear surface of a liquid crystal display (LCD). A plasma type cold cathode electrode tube has been mainly used as the backlight. However, the cold cathode cold cathode electrode tube is not environmentally friendly since the cold cathode electrode tube uses mercury. In addition, it is becoming expensive since the structure is more complicated as it is bigger by using a light guide plate. In this regard, a mercury-free and flat panel type backlight is required. One exemplary backlight is a backlight which employs carbon nanotubes (CNTs).

A triode structure field emission device, as disclosed in U.S. Pat. No. 5,760,858, can solve the above problem, but the manufacturing process of the backlight is as complicated as the manufacturing process of a field emission display (FED). That is, the backlight is manufactured by a semiconductor manufacturing process, including deposition of a plurality of thin films and photolithography, thereby having a high manufacturing cost and a low yield when compared to the manufacturing of an LCD panel having a simple structure.

SUMMARY OF THE INVENTION

The present invention relates to a thermal electron emission backlight device having high brightness by using a thermal electron emitting unit in a space between a rear substrate and a front substrate.

According to an aspect of the present invention, a thermal electron emission backlight device comprises: a first substrate and a second substrate disposed in parallel and separated by a predetermined distance from each other; a first anode electrode and a second anode electrode facing the first anode electrode, the first and second anode electrodes being formed on inner surfaces of the first substrate and the second substrate, respectively; a plurality of cathode electrodes disposed at predetermined intervals and parallel to each other between the first substrate and the second substrate; a phosphor layer formed on the second anode electrode; and a plurality of spacers disposed between the first substrate and the second substrate so as to maintain the predetermined distance therebetween; wherein, when a predetermined voltage is applied to the cathode electrodes, thermal electrons are emitted from the cathode electrodes.

The second anode electrode may be a high reflective electrode.

The thermal electron emission backlight device may further comprise a reflection film between the second anode electrode and the second substrate.

The thermal electron emission backlight device may further comprise a reflection film on a lower surface of the second substrate.

The thermal electron emission backlight device may further comprise a phosphor layer on an outer circumference of the spacers.

The spacers may be conductive spacers which electrically connect the first anode electrode to the second anode electrode.

The spacers may comprise a cylinder formed of a non-metal and a reflection film formed between an outer circumference of the cylinder and the phosphor layer.

The cathode electrode may be formed of tungsten.

The thermal electron emission backlight device may further comprise an electron emitting source material disposed on an outer circumference of the cathode electrode.

The thermal electron emission backlight device may further comprise a carbon group material disposed on a surface of the electron emitting source The thermal electron emission backlight device may further comprise a phosphor layer disposed on the first anode electrode.

BRIEF DESCRIPTION OF THE DRAWINGS

A more complete appreciation of the invention, and many of the attendant advantages thereof, will be readily apparent as the same becomes better understood by reference to the following detailed description when considered in conjunction with the accompanying drawings in which like reference symbols indicate the same or similar components, wherein.

Figure 1:
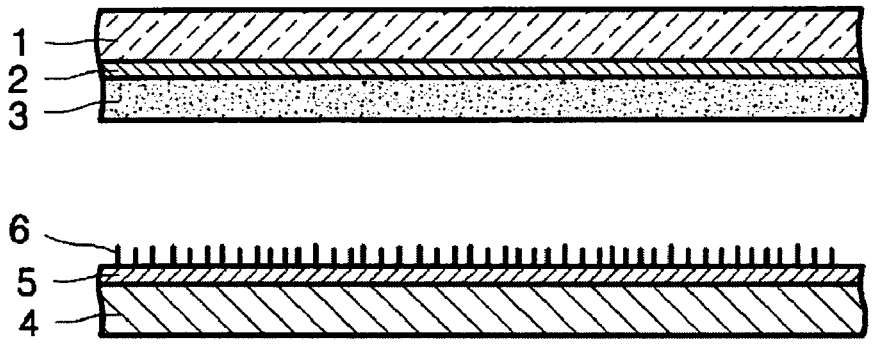
FIG. 1 (PRIOR ART)
FIG. 1 is a cross-section view of a backlight device for a liquid crystal display (LCD)

DETAILED DESCRIPTION OF THE INVENTION the thermal electron emission backlight device according to the present invention will now be described more fully with reference to the accompanying drawings in which exemplary embodiments of the invention are shown. In the drawings, the thicknesses of layers and regions are exaggerated for clarity.

FIG. 1 is a cross-section view of a backlight device for a liquid crystal display (LCD).

Referring to FIG. 1, a spacer (not shown) is disposed between a front substrate 1 and a rear substrate 4. Walls (not shown) between the front substrate 1 and the rear substrate 4 are sealed. A cathode electrode 5 having a plate type shape or a stripe shape is formed on the rear substrate 4. A field emission source 6, such as carbon nanotubes (CNTs), is formed on the cathode electrode 5. An anode electrode 2, which is a transparent electrode, is formed on the front substrate 1. A phosphor layer 3 is coated on the anode electrode 2.

When a predetermined voltage is applied to the cathode electrode 5 and the anode electrode 2, electrons are emitted from the field emission source 6, and collide and excite the phosphor layer 3. Light emitted from the phosphor layer 3 enters into a liquid crystal display (LCD) panel through the anode electrode 2 and the front substrate 1.

A flat backlight device has non-uniform brightness since the electron emission is concentrated on an edge of the cathode electrode 5. Also, in the diode structure as described above, a desired amount of anode current cannot be readily obtained since the control of electron emission is difficult. For example, in a CNT backlight having a diagonal length of 5 inches, to obtain a brightness of 10,000 Cd/$m^2$, the backlight must be operated at an anode voltage of approximately 10 kV, which is a high voltage, and at an anode current of 0.5 to 0.7 mA. Meanwhile, in a diode structure, when a distance between the anode electrode 2 and the cathode electrode 5 is 5 mm, the anode current amount of more than a few mA is generated at anode voltage of 5 kV. That is, in the diode method, the backlight is operated at a low voltage and high current. Thus, realizing a high efficiency backlight is difficult.

Figure 2A:
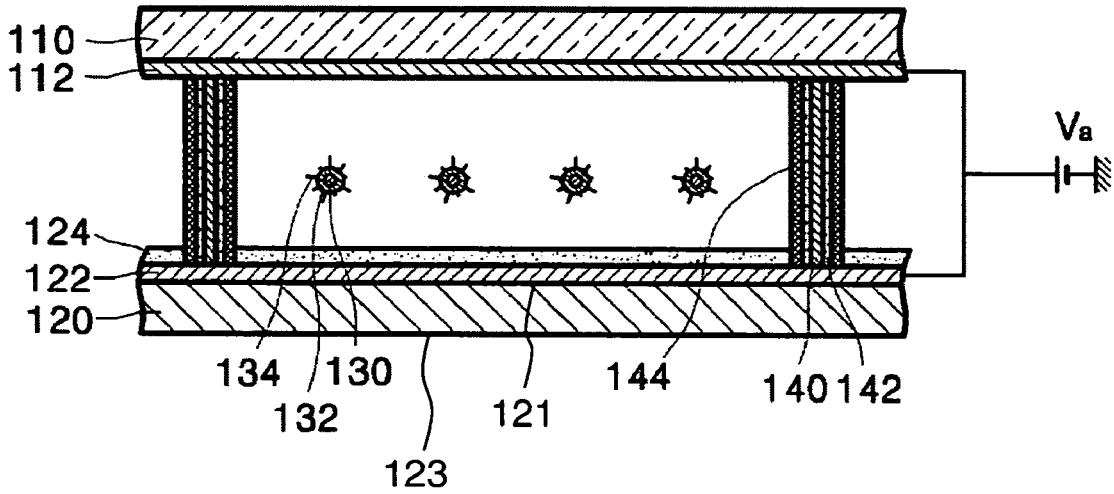
FIGS. 2A and 2B are cross-section views of a thermal electron emission backlight device according to an embodiment of the present invention.
Figure 2B:
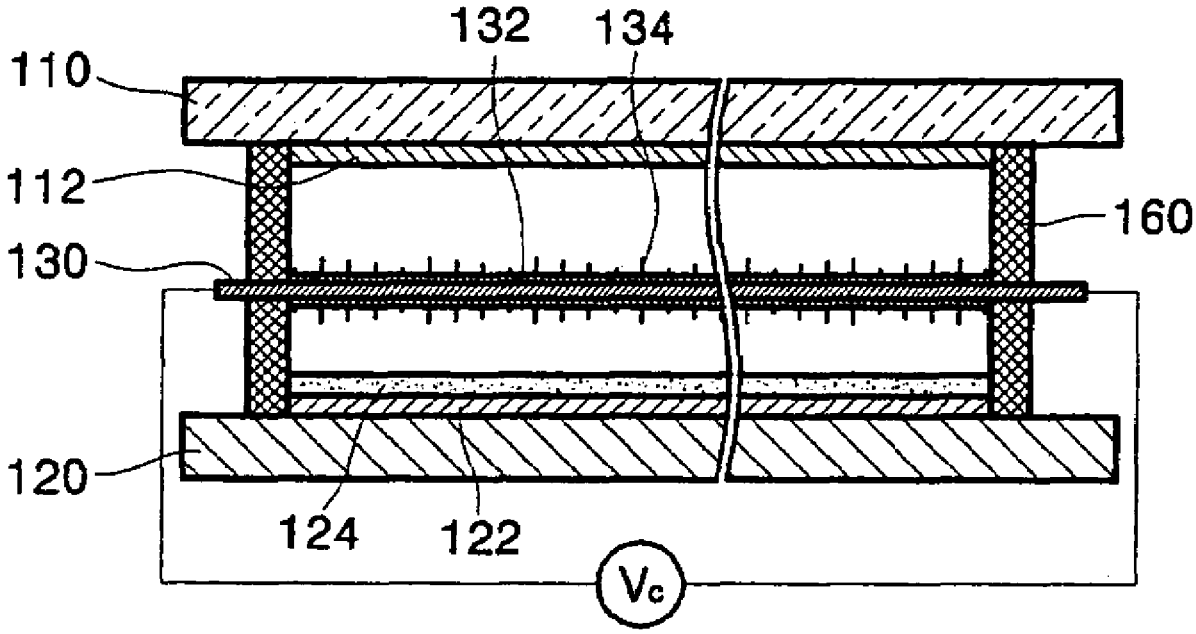

FIGS. 2A and 2B are cross-section views of a thermal electron emission reflective type backlight device according to an embodiment of the present invention.

Referring to FIGS. 2A and 2B, a first substrate 110 and a second substrate 120 are spaced apart from each other by a predetermined distance, such as 5-50 mm, by spacers 140. The first substrate 110 can be formed of a transparent material, such as glass. Light emitted from a phosphor layer 124 passes through the first substrate 110 and a rear surface of an LCD. A first anode electrode 112, which can be an indium tin oxide (ITO) transparent electrode, is disposed on an inner surface of the first substrate 110 in a flat panel shape. A second anode electrode 122 is disposed in a flat panel shape on an inner surface of the second substrate 120. A plurality of cathode electrodes 130 arranged parallel to each other are disposed between the first anode electrode 112 and the second anode electrode 122. The cathode electrodes 130 may respectively have a cylindrical shape. A thermal electron emitting material layer 132, such as $(Ba,Sr,Ca)CO_3$, having a thickness of 5-20 μm is formed on an outer surface of the cathode electrodes 130.

An electron emitting source 134, for example, a carbon group material such as CNT or graphite powder, can be coated on a surface of the thermal electron emitting material layer 132.

The cathode electrodes 130 may be formed of tungsten W with a diameter of 10-250 μm. The thermal electron emitting material layer 132 can be formed to a thickness of 10 μm. The cathode electrodes 130 can be disposed at a distance of 0.3-20 mm from the first and second anode electrodes 112 and 122, respectively.

A direct current (DC) voltage Va of 3-30 kV can be applied to the first anode electrode 112 and the second anode electrode 122, respectively. As depicted in FIG. 2, when the spacer 140 is formed of a conductive material, the same voltage is applied to the first anode electrode 112 and the second anode electrode 122. A DC or alternate current (AC) voltage of a few to a few tens of volts can be applied to both ends of the cathode electrodes 130, depending on the material and length of the cathode electrodes 130.

The first anode electrode 112 can be a transparent electrode formed of, for example, ITO. Although it is not shown in FIG. 2, a phosphor layer can be formed to a predetermined thickness, for example, 0.2 to 6 μm, on an inner surface of the first anode electrode 112. The phosphor layer 124 is excited by thermal electrons emitted from the thermal electron emitting material layer 132 and electrons emitted from the electron emitting source 134, and emits visible light.

The second anode electrode 122 can be formed of a high reflectance material, such as Al. A phosphor layer 124 is formed to a predetermined thickness, for example, 3 to 15 μm on the second anode electrode 122. The phosphor layer 124 is excited by thermal electrons emitted from the thermal electron emitting material layer 132 and electrons emitted from the electron emitting source 134, and emits visible light.

In FIGS. 2A and 2B, if the phosphor layer 124 is not coated on the first anode electrode 112, the backlight device is a reflection type, and if the phosphor layer 124 is coated on the first anode electrode 112, the backlight device is a combination of the reflection type and a transmission type.

Wall frames 160 are formed on an outer rim between the first substrate 110 and the second substrate 120. The wall frames 160 are bonded with melted frit glass so as to seal an inner side of the backlight device. The cathode electrodes 130 can be formed through the wall frames 160, and at least an end of each of the cathode electrodes 130 is tensioned toward the outside. The tension structure of the cathode electrodes 130 can be formed by a conventional technique for tensioning a filament in a vacuum fluorescent display (VFD). Therefore, the detailed descriptions thereof will be omitted.

The spacers 140 are formed of a ceramic material, such as glass or aluminum, and can be formed in a cylindrical column having a thickness of approximately 50-500 μm.

A metal layer 142 can be coated on outer circumferences of the spacers 140 to a thickness of 0.02 to 1 μm. When the metal layer 142 is coated on the circumferences of the spacers 140, the first anode electrode 112 is electrically connected to the second anode electrode 122. Accordingly, a voltage Va applied to the first anode electrode 112 and the second anode electrode 122 is the same. When the metal layer 142 is not formed, different voltages Va are respectively applied to the first anode electrode 112 and the second anode electrode 122.

Also, a phosphor layer 144 having a thickness of 3 to 10 μm may be coated on an outer surface of the metal layer 142. The phosphor layer 144 is excited by accelerated electrons, and emits visible light. In this case, the metal layer 142 may be formed of a high reflectance material, such as Al.

The operation of the field emission type thermal electron emission backlight device according to an embodiment of the present invention will now be described with reference to FIGS. 2A and 2B.

A DC voltage of 10 kV is applied to the first anode electrode 112 and the second anode electrode 122, and a DC voltage of 8 V is applied to both ends of the cathode electrodes 130. Thus, thermal electrons are emitted from the thermal electron emitting material layer 132, and the electrons excite the phosphor layers 124 and 144. Then, the phosphor layers 124 and 144 emit white visible light, and the white visible light is supplied to an LCD panel through the first anode electrode 112 and the first substrate 110. In this case, white light headed toward the second substrate 120 heads toward the first substrate 110 by reflecting at the second anode electrode 122 which is a reflection film. Although it is not shown in FIG. 1, if a phosphor layer is formed on the first anode electrode 112, the phosphor layer excited by thermal electrons emits white light. The white light heads the first substrate 110 passing through the phosphor layer.

In FIGS. 2A and 2B, if an electron emitting source 134, i.e., CNTs, is coated on a surface of the thermal electron emitting material layer 132, the CNTs also emit cold electrons by field emission effect. The cold electrons can also excite the phosphor layers 124 and 144 to generate white visible light from the phosphor layers 124 and 144.

Figure 3:
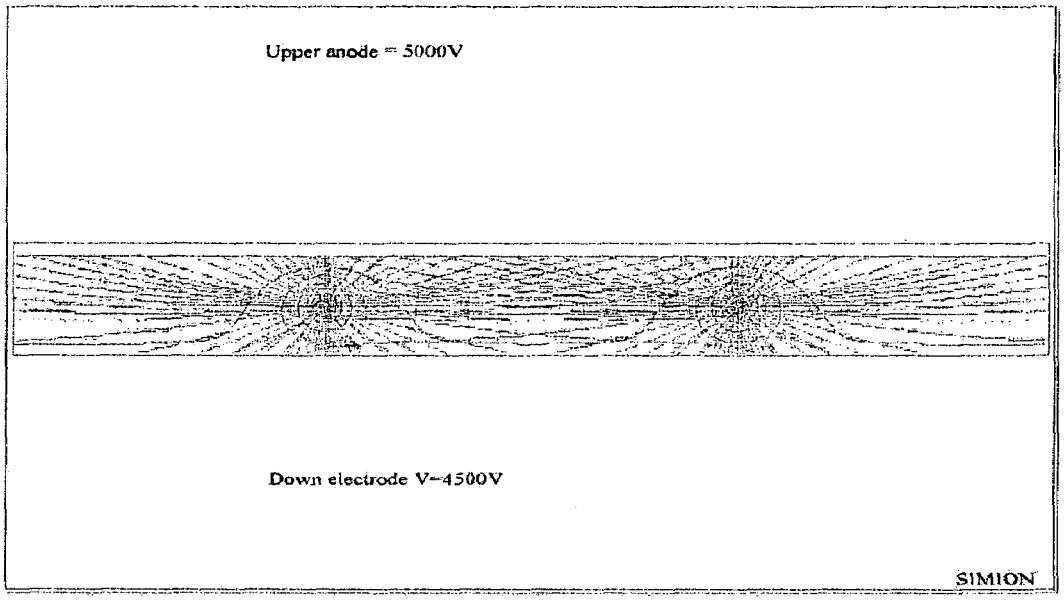
FIG. 3 illustrates a simulation result of the flow of thermal electrons in a thermal electron emission backlight device according to an embodiment of the present invention.

FIG. 3 illustrates a simulation result of the flow of thermal electrons in a thermal electron emission backlight device according to an embodiment of the present invention. Voltage of 5 kV and 4.5 kV are applied to the first anode electrode (upper anode) and the second anode electrode (lower anode), respectively. This simulation is similar in that the same voltage is applied to the first and second anode electrodes.

Referring to FIG. 3, thermal electrons emitted from the thermal electron emitting material layer 132 in response to a voltage applied to the cathode electrodes 130 are uniformly distributed with overlapping in the backlight device. Accordingly, the thermal electron emission backlight device according to the present invention has uniform brightness, and can be used for large size LCDs. Although it is not depicted in FIG. 3, in the backlight device according to an embodiment of the present invention, the degree of dispersion of thermal electrons can be controlled by varying the voltage applied to the first anode electrode 112 and the second anode electrode 122. For example, when a voltage which is higher than a voltage applied to the first anode electrode 112 is applied to the second anode electrode 122, relatively more thermal electrons from cathode electrode 130 can reach the second anode electrode 122 relative to the first anode electrode 112, and thus a reflection-type backlight can be realized.

Figure 4:
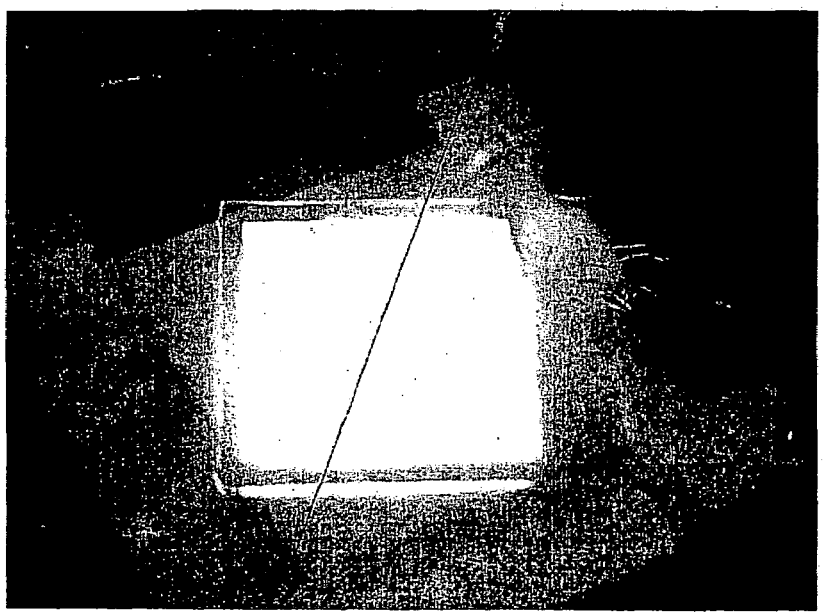
FIG. 4 is a photographed image of light emission from a backlight according to an embodiment of the present invention.

FIG. 4 is a photographed image of light emission from the backlight device according to an embodiment of the present invention. The cathode electrodes 130 used in FIG. 4 are formed of tungsten W to a thickness of 10 μm. A thermal electron emitting material layer 132 formed of(Ba,Sr,Ca)$CO_3$ is coated on an outer circumferential surface of the cathode electrodes 130 to a thickness of 10 μm. The diagonal length of the cathode electrodes 130 is 5 inches, and a voltage of 6V is applied thereto. A voltage of 10 kV is commonly applied to both the first anode electrode 112 and the second anode electrode 122. The first substrate 110 is disposed 15 mm apart from the second substrate 120. As seen in FIG. 4, even if only one cathode electrode (the cathode electrode in FIG. 4 is indicated by a black line) is used, the brightness of the backlight unit is uniform on the 5-inch substrate, and the value is as high as 12,000 Cd/$m^2$.

In FIG. 2, the anode electrode 122 is formed of aluminum Al, which is a high reflective material, but the present invention is not limited thereto. The purpose of the second anode electrode 122 is to reflect electrons. Therefore, an additional reflection layer 121, such as an Al layer, can be disposed between the second anode electrode 122 and the second substrate 120 or on a lower surface 123 of the second substrate 120, and a transparent electrode, such as an ITO electrode, can be used as the second anode electrode 122.

Figure 5A:
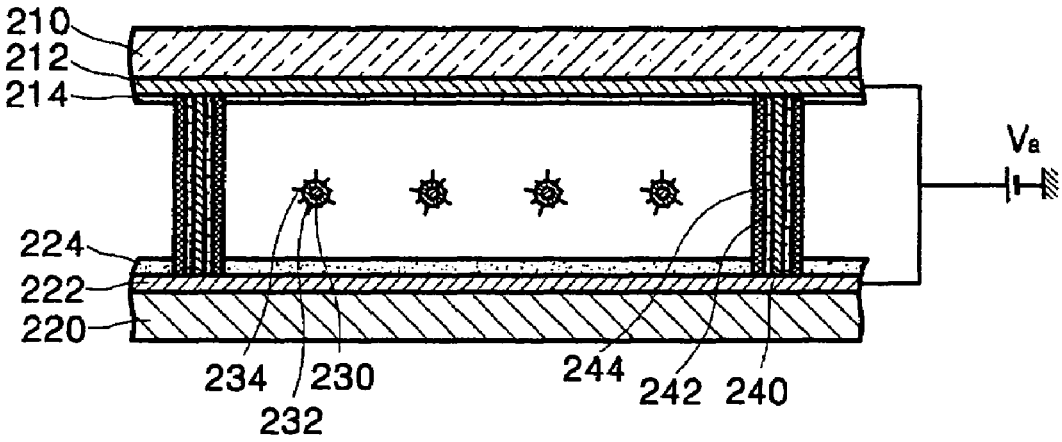
FIGS. 5A and 5B are cross-section views of a thermal electron emission backlight device according to another embodiment of the present invention.
Figure 5B:
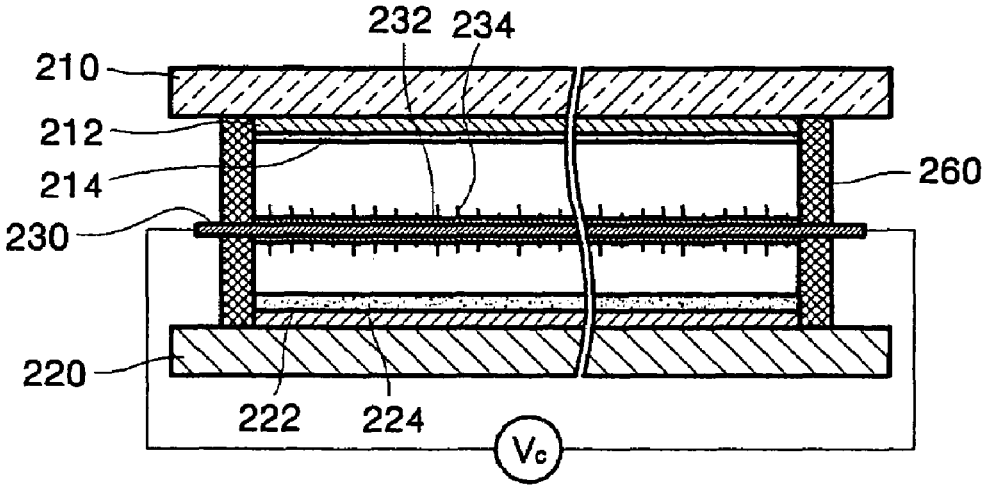

FIGS. 5A and 5B are cross-section views of a thermal electron emission backlight device according to another embodiment of the present invention. The same reference numerals are used to indicate elements identical with those depicted in FIG. 2, and thus a detailed description thereof will be omitted.

Referring to FIGS. 5A and 5B, a first substrate 210 and a second substrate 220 are spaced apart by a predetermined distance by spacers 240. The first substrate 210 can be formed of a transparent material, such as glass. The first substrate 210 is a member through which light emitted from a phosphor layer 214 passes, and is disposed on a rear surface of an LCD. A first anode electrode 212, which can be an ITO transparent electrode, is disposed in a flat panel shape on an inner surface of the first substrate 210. A second anode electrode 222 is disposed in a flat panel shape on an inner surface of the second substrate 220. A plurality of cathode electrodes 230, parallel to each other, are disposed between the first anode electrode 212 and the second anode electrode 222. The cathode electrodes 230 may each have a cylindrical shape. A thermal electron emitting material layer 232, such as (Ba,Sr,Ca)$CO_3$, may be formed on an outer surface of the cathode electrodes 230.

An electron emitting source material 234 (for example, a carbon group material such as CNTs or graphite powder) may be coated on a surface of the thermal electron emitting material layer 232.

The cathode electrodes 230 may be formed of tungsten W with a diameter of 10-250 μm. The cathode electrodes 230 may be disposed at a distance of 0.3-20 mm from the first and second anode electrodes 212 and 222, respectively.

A direct current (DC) voltage Va of 3-20 kV can be applied to the first anode electrode 212 and the second anode electrode 222, and a DC or AC voltage Vc of a few to a few tens of volts can be applied to the cathode electrodes 230, depending on the material and length of the cathode electrodes 230.

A phosphor layer 214 with a predetermined thickness, such as 0.2-6 μm, is coated on the second anode electrode 212. A phosphor layer 224 with a predetermined thickness, such as 3-15 μm, is coated on an inner surface of the second anode electrode 222. The phosphor layers 214 and 224 emit visible light when they are excited by thermal electrons emitted from the thermal electron emitting material layer 232 and electrons emitted from the electron emitting source material 234.

The second anode electrode 222 may be formed of a material having high reflectance, such as aluminum (Al).

The spacers 240 are formed of a ceramic material, such as glass or aluminum, and can be formed in a cylindrical column having a thickness of approximately 50-500 μm. A phosphor layer 244 may further be formed on outer circumferential surfaces of the spacers 240 with a thickness of approximately 3-10 μm.

A highly reflective material film, such as an Al reflection film 242, can further be formed between the spacers 240 and the phosphor layer 244.

Wall frames 260 are formed on an outer rim between the first substrate 210 and the second substrate 220. The wall frames 260 are bonded with melted frit glass so as to seal an inner side of the backlight device. The cathode electrodes 230 can be formed so as to pass through the wall frames 260, and at least one end of each of the cathode electrodes 230 is tensioned toward the outside.

The operation of the field emission type thermal electron emission backlight device will now be described with reference to FIG. 5.

A DC voltage of 10 kV is applied to the first anode electrode 212 and the second anode electrode 222, and a DC voltage of 8 V is applied to both ends of the cathode electrodes 230. Then, thermal electrons are emitted from the thermal electron emitting material layer 232, and the electrons excite the phosphor layers 214, 224 and 244. As a result, the phosphor layers 214, 224 and 244 emit white visible light which is supplied to an LCD panel through the first anode electrode 212 and the first substrate 210.

In FIG. 5, if an electron emitting source 234 (i.e., CNTs) is coated on a surface of the thermal electron emitting material layer 232, cold electrons can be emitted from the CNTs. The phosphor layers 214, 224 and 244 can be excited by the cold electrons, and thus can generate white visible light.

The thermal electron emission backlight device according to the present invention uses a first anode electrode together with a second anode electrode. Therefore, thermal electrons emitted from cathode electrodes are uniformly distributed between the first and second anode electrodes, thereby improving brightness. Accordingly, no diffuser is required, thereby reducing manufacturing cost.

Also, the backlight device can be readily manufactured using only anode electrodes, glass substrates on which phosphor layers are formed, and wires for forming cathode electrodes.

While the present invention has been particularly shown and described with reference to exemplary embodiments thereof, it will be understood by those of ordinary skill in the art that various changes in form and detail may be made therein without departing from the spirit and scope of the present invention as defined by the following claims.

What is claimed is:

1. A thermal electron emission backlight device, comprising:

a first substrate and a second substrate disposed in parallel and separated by a predetermined distance from each other;

a first anode electrode and a second anode electrode facing the first anode electrode, said first anode electrode and said second anode electrode being formed on inner surfaces of the first substrate and the second substrate, respectively;

cathode electrodes disposed at predetermined intervals and in parallel with each other between the first substrate and the second substrate;

a phosphor layer formed on the second anode electrode; and a plurality of spacers disposed between the first substrate and the second substrate so as to maintain the predetermined distance therebetween;

wherein, when a predetermined voltage is applied to the cathode electrodes, thermal electrons are emitted from the cathode electrodes;

wherein the spacers are conductive spacers which electrically connect the first anode electrode to the second anode electrode.

2. The thermal electron emission backlight device of claim 1, wherein the second anode electrode is a highly reflective electrode.

3. The thermal electron emission backlight device of claim 2, wherein the second anode electrode is formed of aluminum.

4. The thermal electron emission backlight device of claim 1, further comprising a reflection film disposed between the second anode electrode and the second substrate.

5. The thermal electron emission backlight device of claim 1, further comprising a reflection film disposed on a lower surface of the second substrate.

6. The thermal electron emission backlight device of claim 1, further comprising a phosphor layer disposed on outer circumferences of the spacers.

7. The thermal electron emission backlight device of claim 1, wherein each of the spacers comprises:

a cylinder formed of a non-metal; and a reflection film formed between an outer circumference of the cylinder and the phosphor layer.

8. The thermal electron emission backlight device of claim 1, wherein the cathode electrodes are formed of tungsten.

9. The thermal electron emission backlight device of claim 8, wherein each of the cathode electrodes has a diameter in a range of 10-250 μm.

10. The thermal electron emission backlight device of claim 1, further comprising an electron emitting source material disposed on outer circumferences of the cathode electrodes.

11. The thermal electron emission backlight device of claim 10, wherein the electron emitting source material has a thickness in a range of 5-20 μm.

12. The thermal electron emission backlight device of claim 10, further comprising a carbon group material disposed on a surface of the electron emitting source material.

13. The thermal electron emission backlight device of claim 1, further comprising an additional phosphor layer disposed on the first anode electrode.

14. The thermal electron emission backlight device of claim 1, wherein the first anode electrode and the second anode electrode have flat panel shapes.

15. The thermal electron emission backlight device of claim 1, wherein each of the spacers comprises:

a cylinder formed of a non-metal; and a reflection film formed between an outer circumference of the cylinder and the phosphor layer.

16. The thermal electron emission backlight device of claim 1, wherein each of the spacers comprises:

a cylinder formed of a non-metal; and a reflection film formed between an outer circumference of the cylinder and the phosphor layer.

* * * * *